US008646570B2

(12) United States Patent
Akino

(10) Patent No.: US 8,646,570 B2
(45) Date of Patent: Feb. 11, 2014

(54) DIAPHRAGM OF ELECTRIC SOUND CONVERTER AND ITS MANUFACTURING METHOD

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 0 days.

(21) Appl. No.: 13/566,355

(22) Filed: Aug. 3, 2012

(65) Prior Publication Data

US 2013/0043090 A1 Feb. 21, 2013

(30) Foreign Application Priority Data

Aug. 19, 2011 (JP) ..... 2011-179411

(51) Int. Cl.

| | |
|---|---|
| ***H04R 7/10*** | (2006.01) |
| ***H04R 7/14*** | (2006.01) |
| *G10K 13/00* | (2006.01) |
| *H04R 7/00* | (2006.01) |
| *H04R 7/12* | (2006.01) |

(52) U.S. Cl.

USPC ..... 181/174; 181/167; 181/170; 381/423; 381/425; 381/426; 381/430

(58) Field of Classification Search

USPC ..... 181/174, 173, 167, 170, 166, 168, 169; 381/423, 425, 426, 427, 428, 429, 430

See application file for complete search history.

(56) References Cited

U.S. PATENT DOCUMENTS

| | | | | | |
|---|---|---|---|---|---|
| 1,870,417 | A | * | 8/1932 | Mallina | 181/170 |
| 3,834,486 | A | * | 9/1974 | Tsuge et al. | 181/165 |
| 4,086,450 | A | * | 4/1978 | Inoue | 181/173 |
| 4,135,601 | A | * | 1/1979 | Tsukagoshi et al. | 181/167 |
| 4,351,411 | A | * | 9/1982 | Inoue | 181/168 |
| 4,434,203 | A | * | 2/1984 | Briefer | 428/152 |
| 4,562,899 | A | * | 1/1986 | Nakamura | 181/169 |
| 5,259,036 | A | * | 11/1993 | Seeler | 381/426 |
| 5,304,746 | A | * | 4/1994 | Purvine | 181/148 |
| 5,701,359 | A | * | 12/1997 | Guenther et al. | 381/431 |
| 5,721,786 | A | * | 2/1998 | Carrington | 381/423 |
| 5,744,761 | A | * | 4/1998 | Ogura et al. | 181/167 |
| 5,991,425 | A | * | 11/1999 | Anagnos | 381/423 |
| 6,141,430 | A | * | 10/2000 | Imahori et al. | 381/417 |

(Continued)

FOREIGN PATENT DOCUMENTS

| | | | | | |
|---|---|---|---|---|---|
| JP | 56114498 | A | * | 9/1981 | H04R 7/04 |
| JP | 58129900 | A | * | 8/1983 | H04R 7/10 |

(Continued)

*Primary Examiner* — Edgardo San Martin

(74) *Attorney, Agent, or Firm* — Manabu Kanesaka

(57) ABSTRACT

In a diaphragm of an electric sound converter which converts vibration such as sound into an electrical signal, a center dome is reinforced while suppressing variations in the sensitivity and frequency response to the minimum, whereby reduction in a high-pass reproduction limit is suppressed, and occurrence of anomalous resonance is prevented. In a diaphragm 1 of an electric sound converter having a center dome 2, a reinforcing film 7 made of the same material as that of the center dome and formed into the same shape as that of the center dome is applied to the center dome with a hot-melt adhesive 6 of the same nature as that of the center dome, a groove 7*a* formed in a polygonal reticulate pattern is provided on one surface of the reinforcing film adhered with the adhesive, and a convex rib 8 corresponding to the groove is formed on the other surface.

5 Claims, 6 Drawing Sheets

(56) References Cited

U.S. PATENT DOCUMENTS

| | | | | |
|---|---|---|---|---|
| 6,377,695 | B1 * | 4/2002 | Azima et al. | 381/152 |
| 6,757,404 | B2 * | 6/2004 | Takewa et al. | 381/430 |
| 6,920,957 | B2 * | 7/2005 | Usuki et al. | 181/173 |
| 6,957,714 | B2 * | 10/2005 | Takahashi et al. | 181/171 |
| 7,120,263 | B2 * | 10/2006 | Azima et al. | 381/152 |
| 7,467,686 | B2 * | 12/2008 | Imamura et al. | 181/167 |
| 7,483,545 | B2 * | 1/2009 | Nagaoka | 381/423 |
| 7,801,324 | B2 * | 9/2010 | Kimura et al. | 381/430 |
| 8,068,634 | B2 * | 11/2011 | Tsuchiya | 381/425 |
| 8,199,962 | B2 * | 6/2012 | Maeda | 381/398 |
| 8,345,916 | B2 * | 1/2013 | Schulze et al. | 381/423 |
| 8,363,858 | B2 * | 1/2013 | Akino | 381/174 |
| 8,442,261 | B2 * | 5/2013 | Kamimura et al. | 381/423 |
| 2004/0146176 | A1 * | 7/2004 | Wu | 381/425 |
| 2010/0296687 | A1 * | 11/2010 | Fujita et al. | 381/398 |

FOREIGN PATENT DOCUMENTS

| | | | | |
|---|---|---|---|---|
| JP | 59191999 | A * | 10/1984 | H04R 7/10 |
| JP | 02057097 | A * | 2/1990 | H04R 7/02 |
| JP | 3049570 | | 3/2012 | |

* cited by examiner

DIAPHRAGM OF ELECTRIC SOUND CONVERTER AND ITS MANUFACTURING METHOD

BACKGROUND OF THE INVENTION

1. Field of the Invention

The present invention relates to a diaphragm of an electric sound converter which converts vibration such as sound into an electrical signal, and relates particularly to a diaphragm in which there is a center dome portion reinforced while suppressing variations in the sensitivity and frequency response to the minimum, and a method of manufacturing the diaphragm.

2. Description of the Related Art

In a diaphragm in dynamic microphones and headphones, for example, in order to expand the low-pass reproduction limit, there is a method of forming a film of a sub-dome portion of the diaphragm such that the film thickness is small and reducing a resonance frequency. When this method is executed, a film such as polyester is placed on a forming die to be heated and processed, and a thin diaphragm is formed.

However, in the above case, not only the thickness of the sub-dome portion is reduced, but also the thickness of the center dome portion is reduced, and therefore, there is a problem that the mechanical strength of the center dome portion is reduced, and a high-pass reproduction limit is reduced, so that anomalous resonance easily occurs.

In order to solve the above problem, the center dome portion has been reinforced by a method of applying a reinforcing film having the same shape as that of the center dome portion to the center dome portion.

However, in the method of applying the reinforcing film to the center dome portion, when materials of the film and an adhesive are different from a material of the center dome portion, their thermal expansion coefficients are different from each other, and therefore there is a problem that a thermal deformation due to a temperature change occurs as in bimetal. Further, there is a problem that an individual difference is generated due to the thermal deformation and the frequency response and the sensitivity vary.

In order to solve the above problem, the present applicant has been proposed a diaphragm disclosed in Japanese Patent No. 3049570. In this diaphragm, a center dome portion is made of the same material as the diaphragm, and a reinforcing film formed to have the same shape as that of the center dome portion is applied with a hot-melt adhesive of the same nature as that of the diaphragm.

When the above diaphragm is manufactured, as shown in FIG. 10, a reinforcing film 51 having a diameter substantially equal to a diameter of a center dome is placed above a forming die 50 and then covered from the above with a base film 52, and a pressure pot (not shown) is moved toward the forming die, whereby the diaphragm is formed.

At this time, the reinforcing film 51 is also applied to the film with a hot-melt adhesive 53. At the same time, an organic solvent of the hot-melt adhesive 53 is vaporized by heat of the forming die 50, and the hot-melt adhesive 53 is cured. Consequently, a center dome 55 applied with the reinforcing film 51 at the central portion and a sub-dome 56 are formed as shown in FIG. 11.

According to the above constitution, since the base film 52, the reinforcing film 51, and the hot-melt adhesive 53 are formed of homogeneous materials, the variations in the sensitivity and the frequency response due to a temperature change can be suppressed to the minimum.

However, in the constitution disclosed in the Japanese Patent No. 3049570, when the hot-melt adhesive 53 is melted at the formation of the diaphragm, the hot-melt adhesive 53 is less likely to be spread in a horizontal direction because of the high viscosity, and a thickness unevenness of an adhesive layer of the center dome 55 may occur.

When the thickness unevenness of the adhesive layer of the center dome 55 occurs, there is a problem that an individual difference is generated in sound quality due to the variations in the sensitivity and the frequency response.

SUMMARY OF THE INVENTION

The present invention has been made while paying attention to the above-described points and provides a diaphragm of an electric sound converter, which converts vibration such as sound into an electrical signal, and a method of manufacturing the diaphragm. In this diaphragm, a center dome is reinforced while suppressing variations in the sensitivity and the frequency response to the minimum, whereby it is possible to suppress the reduction in a high-pass reproduction limit and prevent the occurrence of anomalous resonance.

In order to solve the above problem, the diaphragm of an electric sound converter according to the present invention is characterized in that in a diaphragm of an electric sound converter having a center dome, a reinforcing film made of the same material as that of the center dome and formed into the same shape as that of the center dome is applied to the center dome with a hot-melt adhesive of the same nature as that of the center dome, a groove formed in a polygonal reticulate pattern is provided on one surface of the reinforcing film applied with the adhesive, and a convex rib corresponding to the groove is formed on the other surface of the reinforcing film.

Further, it is desirable that the adhesive is filled in the groove formed in a polygonal reticulate pattern.

Furthermore, it is desirable that the polygon is a hexagonal pattern, and the groove and a convex rib corresponding to the groove are each formed in a honeycomb pattern.

As described above, a groove formed in a polygonal reticulate pattern is provided on a surface of the reinforcing film applied with an adhesive, whereby when a diaphragm is formed, an adhesive melted by heating can be supplied into the groove of the reinforcing film even if the adhesive has a viscosity.

Consequently, an adhesive surface to the center dome can be uniformed, and the variations in the sensitivity and the frequency response to sound pressure (variation in a sound quality difference) can be suppressed.

A convex rib corresponding to the groove is formed on the other surface of the reinforcing film, whereby the mechanical strength of the center dome is enhanced, and the effect of improving sound quality can be obtained.

Further, in order to solve the above problem, the method of manufacturing a diaphragm of an electric sound converter according to the present invention is characterized by a method of manufacturing a diaphragm of an electric sound converter having a center dome, including: forming a reinforcing film, made of the same material as that of the center dome and formed into the same shape as that of the center dome, with a first heated die being provided with a first pressed surface having the same shape as that of the center dome; applying a hot-melt adhesive which is capable of being diluted with an organic solvent and is of the same nature as that of the center dome, to one of formed surfaces of the reinforcing film; punching the formed surface of the reinforcing film; and with the use of a second heated die being provided with a second pressed surface in which a groove formed in a polygonal reticulate pattern is formed on a surface having the same shape as that of the first pressed surface, placing the punched reinforcing film on the second heated die to cover the reinforcing film from above with a diaphragm film, and, thus, to fix the reinforcing film to the diaphragm film with the second heated die.

By executing the above process, a diaphragm of an electric sound converter providing the above-described effect can be obtained.

According to the present invention, the diaphragm of an electric sound converter which converts vibration such as sound into an electrical signal is reinforced while suppressing the variations in the sensitivity and the frequency response in the center dome to the minimum, whereby it is possible to suppress the reduction of a high-pass reproduction limit and prevent the occurrence of anomalous resonance.

DESCRIPTION OF THE PREFERRED EMBODIMENTS

Figure 1:
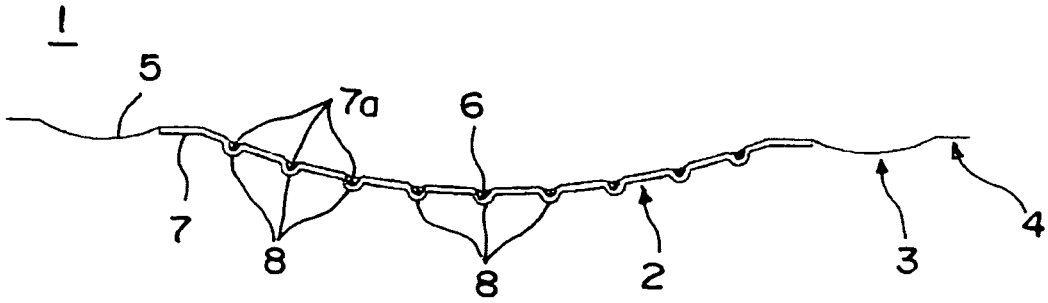
FIG. 1 is a cross-sectional view showing an embodiment of a diaphragm of the present invention.
Figure 2:
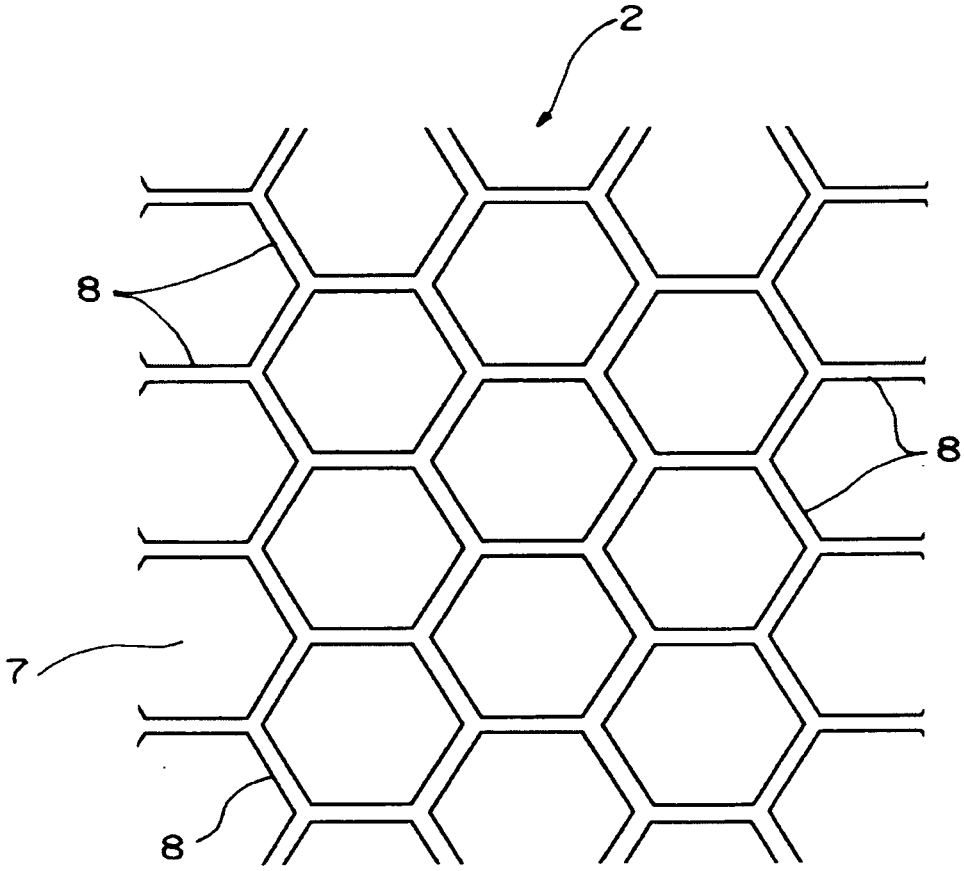
FIG. 2 is a plan view of a portion shown from the lower part of the portion of a center dome portion of the diaphragm of FIG. 1.

Hereinafter, an embodiment of the present invention will be described based on the drawings. FIG. 1 is a cross-sectional view showing an embodiment of a diaphragm of this invention. FIG. 2 is a plan view of a portion shown from the lower part of the portion of a center dome portion of FIG. 1.

As shown in FIG. 1, a diaphragm 1 is provided with a center dome 2, a sub-dome 3 formed to surround the outer circumference of the center dome 2, and a flat peripheral edge 4 formed to surround the outer circumferential portion of the sub-dome 3. Those components are constituted of a base film 5 constituted of, for example, a polyester film having a thickness of approximately 9 μm, and a domed reinforcing film 7 applied to the center dome 2 through an adhesive 6.

The reinforcing film 7 uses a polyester film made of the same material as that of the film 5 having a thickness of 25 μm, for example, and a groove 7*a* formed in a polygonal reticulate pattern, more specifically into a honeycomb pattern (hexagonal pattern) is provided on the concave surface side.

Further, a honeycomb convex rib 8 corresponding to the groove portion 7*a* is formed on the convex surface side of the reinforcing film 7, as shown in FIGS. 1 and 2. In the honeycomb pattern (regular hexagonal pattern) formed by the convex rib 8, the length of one side thereof is approximately 1 mm, for example.

The adhesive 6 is filled in the groove 7*a* and cured, and the adhesive 6 interposed between the base film 5 and the reinforcing film 7 has a large thickness in the honeycomb convex rib 8 (groove 7*a*) and has a smaller thickness in other portions. Thus, the mechanical strength of the center dome 2 is higher in comparison with a conventional constitution (disclosed in the Patent Document 1).

As the adhesive 6, a polyester hot-melt adhesive which is capable of being diluted with an organic solvent is used.

Subsequently, a method of manufacturing the diaphragm 1 will be described using FIGS. 3 to 9.

Figure 3:
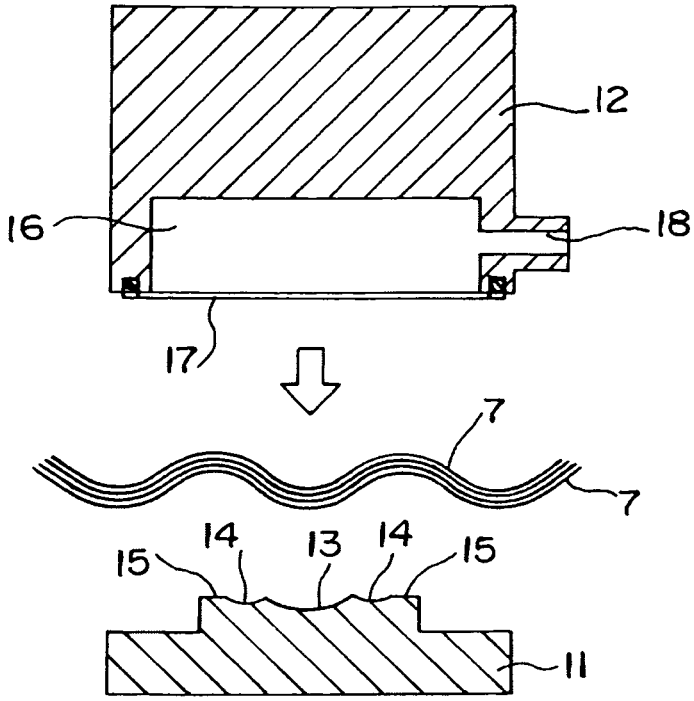
FIG. 3 is a cross-sectional view for explaining a method of manufacturing the diaphragm of FIG. 1 and a view for explaining a process of forming a reinforcing film into a dome shape.

First, the domed reinforcing film 7 is formed by a first forming die 11 (first heated die) for formation of the diaphragm and a pressure pot 12 shown in FIG. 3.

The first forming die 11 has a concave 13 (first pressed surface) having the same shape as that of the center dome 2 and formed at the center of the upper surface of the first forming die 11 so that the diaphragm 1 is formed. The first forming die 11 further has a concave 14 formed so as to surround the outer circumference of the concave 13 and having the same shape as that of the sub-dome 3. The outer circumferential portion of the concave 14 is a flat portion 15 because the peripheral edge 4 is formed.

The pressure pot 12 has a cross section formed into a substantially U-shape and includes a pressure chamber 16, and the opening portion of the pressure pot 12 is positioned so as to be set opposed to the upper surface of the first forming die 11. The pressure pot 12 is fixed to a cylinder rod or the like (not shown) and moves vertically. An O-ring 17 for ensuring airtightness is attached to an end edge of the opening portion of the pressure pot 12. A pressure air supply port 18 configured to be connected to a pressure air supply source (not shown) is formed in a side surface of the pressure pot 12. Since a conventional hot-forming device has those components, detailed description of the structures of those components will be omitted.

The reinforcing film 7 is placed on the first forming die 11 heated to a previously set temperature. The pressure pot 12 is moved downward, and the reinforcing film 7 is held between the first forming die 11 and the end edge of the opening portion of the pressure pot 12 and fixed. Pressure air is then supplied into the pressure chamber 16 through the pressure air supply port 18, and the reinforcing film 7 is formed by air pressure and heat to have a shape corresponding to the concaves 13 and 14 formed on the upper surface of the first forming die 11. A plurality of the reinforcing films 7 can be formed collectively as illustrated.

Figure 4:
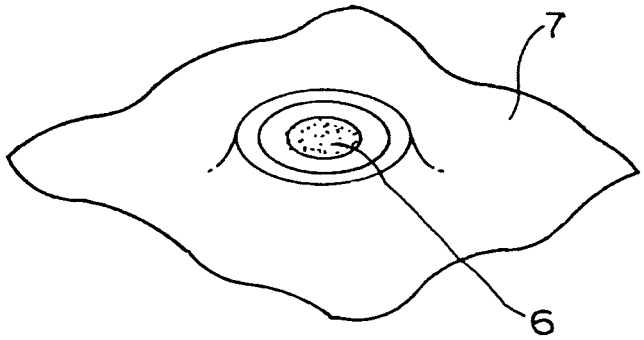
FIG. 4 is a perspective view showing the domed reinforcing film formed in the forming process in FIG. 3.

The adhesive 6 is applied to a central concave of the reinforcing film 7 formed as above, as shown in FIG. 4. The adhesive 6 may be applied so as to be extended from the outline of the central concave of the reinforcing film 7.

Figure 5:
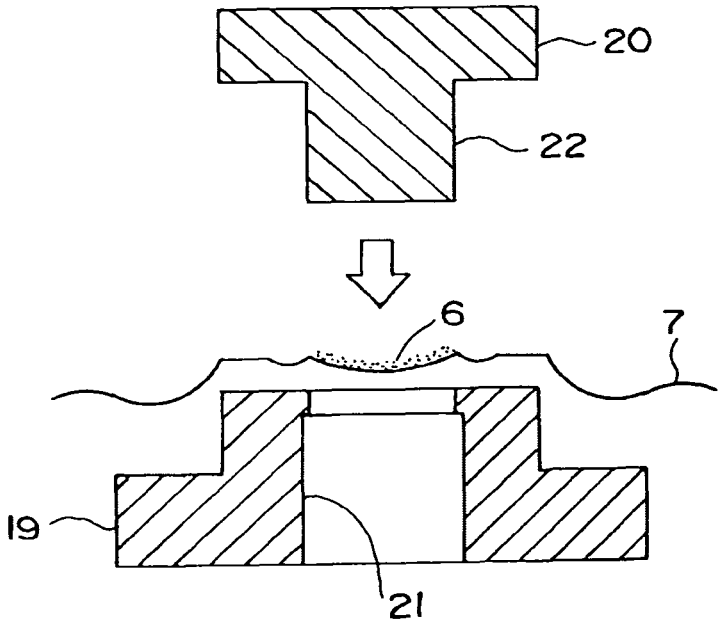
FIG. 5 is a cross-sectional view for explaining a process of punching the domed reinforcing film.

Next, only the central concave of the reinforcing film 7 is punched out by a pair of trimming dies 19 and 20 as shown in FIG. 5. Namely, the reinforcing film 7 is placed on the concave trimming die 19 having a through hole 21 with a diameter substantially equal to the diameter of the center dome 2 so that the central concave of the reinforcing film 7 is fitted into the through hole 21. The convex trimming die 20 having a punch 22 fitted into the through hole 21 is moved downward, and the punch 22 is fitted into the through hole 21, whereby only the central concave of the reinforcing film 7 can be punched out.

Figure 6:
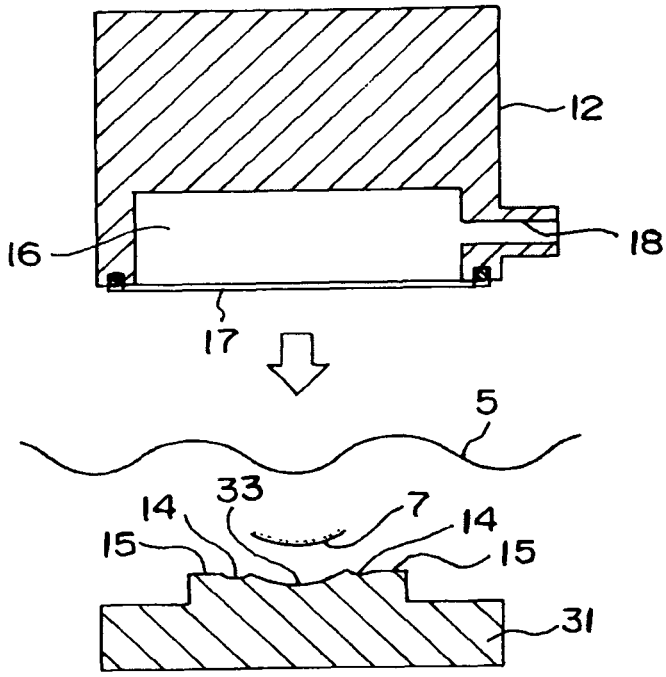
FIG. 6 is a cross-sectional view for explaining a process of forming the diaphragm using the reinforcing film obtained in the process in FIG. 5.

The reinforcing film 7 formed as above is placed on a concave 33 of a second forming die 31 (second heated die) as shown in FIG. 6 to be covered from above with the base film 5 (diaphragm film), and the pressure pot 12 of FIG. 3 is moved downward to form the center dome 2 and the sub-dome 3 on the base film 5.

Although the second forming die 31 has substantially the same shape as that of the first forming die 11 shown in FIG. 3, the second forming die 31 has the concave 33 (second pressed surface) instead of the concave 13.

Figure 7:
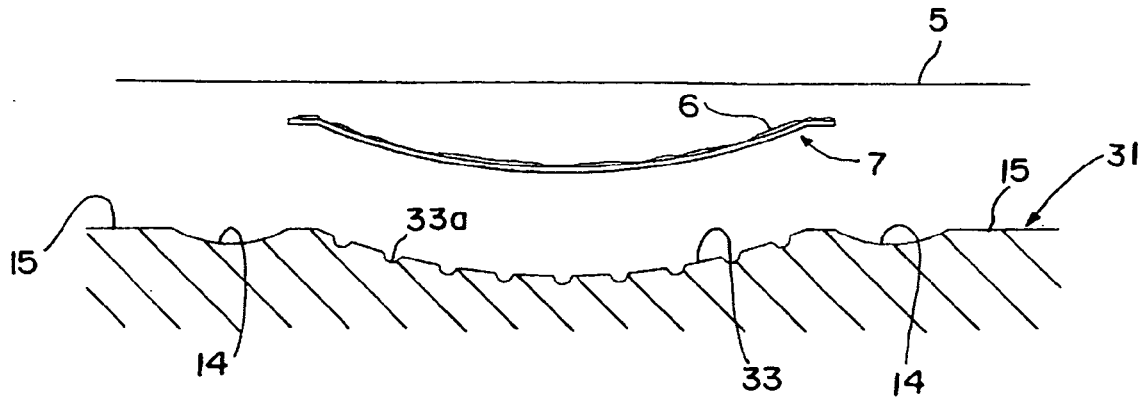
FIG. 7 is a partially enlarged cross-sectional view of FIG. 6.

The concave 33 has a honeycomb groove 33*a* formed on the entire concave as shown in FIG. 7. The groove 33*a* is used for the formation of the honeycomb convex rib 8 shown in FIG. 2.

In the above process, the reinforcing film 7 is applied to the base film 5 with the adhesive 6, and, at the same time, the honeycomb groove 7*a* is formed on the reinforcing film 7 by heat of the second forming die 31 so as to follow the shape of the groove 33*a*.

The adhesive 6 applied to the concave of the reinforcing film 7 is melted and expanded to become uniform in a plane direction; however, the melted adhesive 6 is flowed into the groove 7*a* of the reinforcing film 7, whereby the thickness of the adhesive 6 becomes uniform in the plane direction.

Figure 8:
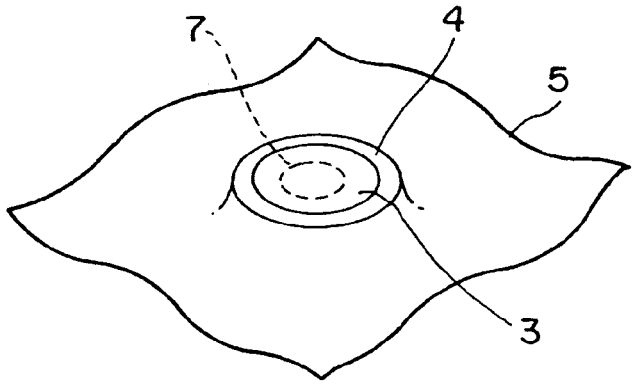
FIG. 8 is a perspective view showing the diaphragm obtained in the forming process in FIG. 6.

Then, the organic solvent is vaporized to cure the adhesive 6, and, as shown in FIG. 8, the center dome 2 applied with the reinforcing film 7 and the sub-dome 3 are formed at the central portion of the film 5.

Further, the honeycomb convex rib 8 shown in FIGS. 1 and 2 is formed on a convex surface of the reinforcing film 7 applied to the center dome 2.

Figure 9:
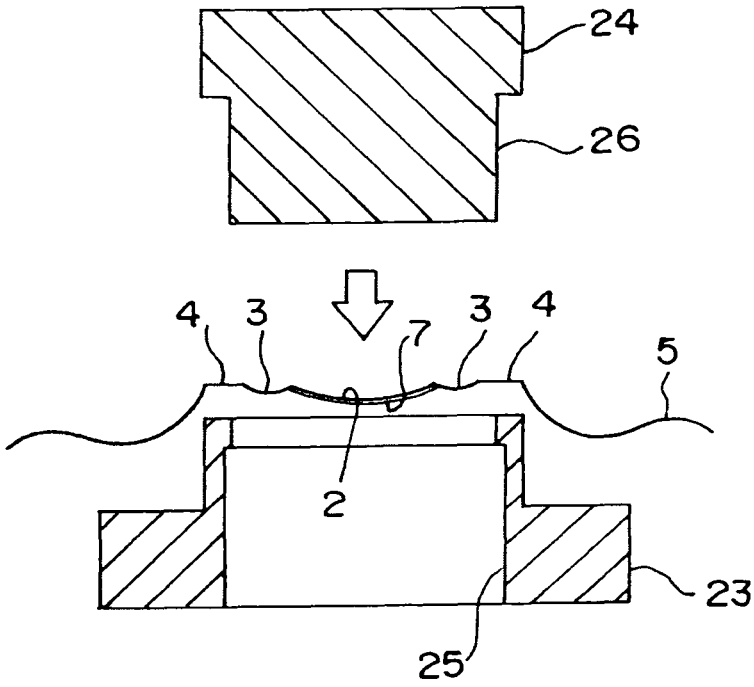
FIG. 9 is a cross-sectional view for explaining a punching process of punching the diaphragm so that the diaphragm has a predetermined size.
Figure 10:
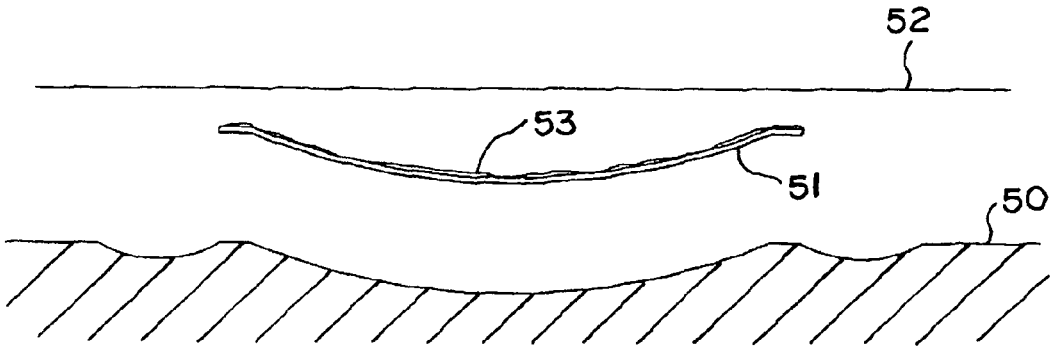
FIG. 10 is a cross-sectional view for explaining a method of manufacturing a conventional diaphragm.
Figure 11:
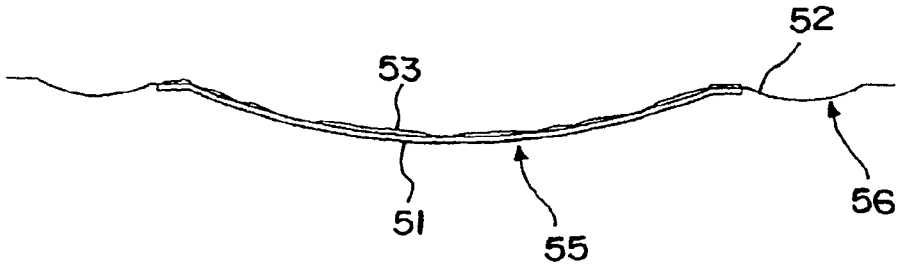
FIG. 11 is a cross-sectional view of the diaphragm obtained by the manufacturing method of FIG. 10.

The base film 5 formed as above is punched out into the shape corresponding to the outer diameter of the diaphragm 1 shown in FIG. 1 by a pair of trimming dies 23 and 24 shown in FIG. 9. Namely, the base film 5 is placed on the concave trimming die 23 having a through hole 25 with a diameter substantially equal to the outer diameter of the peripheral edge 4 of the diaphragm 1 such that the central portion of the base film 5 is positioned at the center of the through hole 25, and the convex trimming die 24 having a punch 26 fitted into the through hole 25 is moved downward to fit the punch 26 into the through hole 25, whereby the diaphragm 1 can be punched out.

As described above, according to the embodiment of the present invention, the reinforcing film 7 made of the same material as that of the center dome 2 and formed into the same shape as that of the center dome 2 is applied to the center dome 2 with the hot-melt adhesive 6 of the same nature as that of the center dome 2.

The groove 7*a* formed in a honeycomb pattern is provided on a surface (concave surface) of the reinforcing film 7 applied with the adhesive 6. Thus, when the diaphragm 1 is formed, the adhesive 6 melted by heating is flowed into the groove 7*a* of the reinforcing film 7 even if the adhesive 6 has a viscosity, and the adhesive surface to the base film 5 becomes uniform. Accordingly, the variation in the sensitivity and the frequency response to sound pressure (variation in the sound quality difference) can be suppressed.

The convex rib 8 corresponding to the groove 7*a* is formed on the other surface (convex surface) of the reinforcing film 7. Thus, the mechanical strength of the center dome 2 is increased, and the effect of improving the sound quality can be obtained.

In the above embodiment, the groove 7*a* formed in a honeycomb pattern (hexagonal pattern) is provided on the concave surface side of the reinforcing film 7, and the honeycomb convex rib 8 corresponding to the groove 7*a* is provided on the convex surface side of the reinforcing film 7.

However, in the constitution of the diaphragm 1 according to the present invention, the groove 7*a* and the convex rib 8 are not limited to be formed in a honeycomb pattern and may be formed in a polygonal reticulate pattern. A polygon that can be configured into a reticulate pattern includes triangle and square.

What is claimed is:

1. A diaphragm of an electric sound converter, comprising:

a diaphragm film having a center dome, a reinforcing film made of a same material as that of the diaphragm film and having a same shape as that of the center dome, and a hot-melt adhesive having same nature as that of the diaphragm film and interposed between the diaphragm film and the reinforcing film to fix the diaphragm film and the reinforcing film, wherein the reinforcing film includes a concave surface side where the adhesive is applied having a groove formed in a polygonal reticulate pattern, and a convex surface side, at an opposite side of the concave surfaces side, having a convex rib corresponding to the groove, and the groove is filled with the adhesive and cured so that the adhesive interposed between the diaphragm film and the reinforcing film in the convex rib has a thickness greater than other portions.

2. The diaphragm of an electric sound converter according to claim 1, wherein the the polygonal reticulate pattern is a hexagonal pattern, and the groove and the convex rib corresponding to the groove are each formed in a honeycomb pattern.

3. A method of manufacturing a diaphragm of an electric sound converter having a center dome, comprising:

preparing a reinforcing film made of a same material as that of the center dome with a first die having a first pressed surface to thereby form the reinforcing film with a same shape as that of the center dome;

applying a hot-melt adhesive, which is capable of being diluted with an organic solvent and is of same nature as that of the center dome, to one of formed surfaces of the reinforcing film;

punching the reinforcing film;

placing the punched reinforcing film on top of a second die having a second pressed surface formed with a groove in a polygonal reticulate pattern and having a same shape as that of the first pressed surface;

covering the reinforcing film from above with a diaphragm film;

adhering the reinforcing film to the diaphragm film with the adhesive; and forming a film groove in the polygonal reticulate pattern on a concave surface side where the reinforcing film is applied with the adhesive, and a convex rib on a convex surface side, opposite to the concave surface side, corresponding to the groove, wherein the forming of the film groove further includes filling the film groove with the adhesive so that the adhesive interposed between the diaphragm film and the reinforcing film in the convex rib has a thickness greater than other portions.

4. The method of manufacturing a diaphragm according to claim 3, wherein the diaphragm film is formed to have the center dome and sub-domes surrounding the center dome.

5. The method of manufacturing a diaphragm according to claim 4, wherein the reinforcing film is adhered onto the diaphragm film with heat and pressure so that the adhesive is evenly spread between the reinforcing film and the diaphragm film and flows into the film groove.

* * * * *